US005088731A

United States Patent [19]

Carpenter

[11] Patent Number: 5,088,731

[45] Date of Patent: Feb. 18, 1992

[54] ARM EXERCISE MACHINE

[75] Inventor: David P. Carpenter, Dunkirk, Md.

[73] Assignee: M. Michael Carpenter, Los Angeles, Calif.

[21] Appl. No.: 605,990

[22] Filed: Oct. 29, 1990

[51] Int. Cl.[5] ..... A63B 23/04; A61H 1/02

[52] U.S. Cl. ..... 272/131; 272/132; 128/25 R

[58] Field of Search ..... 272/130, 131, 132, 93, 272/72, 71, 96, 67, 68; 128/25 R, 25 B

[56] References Cited

U.S. PATENT DOCUMENTS

| | | | |
|---|---|---|---|
| 2,543,729 | 2/1951 | Magida | 272/132 |
| 2,832,334 | 4/1958 | Whitelaw | 272/132 |
| 3,953,025 | 4/1976 | Mazman | 272/132 |
| 4,844,454 | 7/1989 | Rogers | 128/25 R |

FOREIGN PATENT DOCUMENTS

| | | | |
|---|---|---|---|
| 3526144 | 1/1987 | Fed. Rep. of Germany | 272/130 |

*Primary Examiner*—Stephen R. Crow
*Attorney, Agent, or Firm*—M. Michael Carpenter

[57] ABSTRACT

An arm exercise machine is shown having a housing with a pivot mechanism therein. Extending from the housing are first and second braces which extend in opposite directions with the pivot there between. A pivot rod is attached to the pivot mechanism and may be rotated about that mechanism by a user grasping the pivot rod. During such rotation, the first and second braces support the housing and counteract the user's rotation.

15 Claims, 4 Drawing Sheets

ARM EXERCISE MACHINE

BACKGROUND OF THE INVENTION

1. Field of the Invention

The present invention relates to exercise machines and, more particularly, to a machine for exercising the arm of its user. This machine is light and portable and may be used to exercise all of the major muscle groups within the user's arms.

2. Description of the Prior Art

The average person in the 1990's is likely to be working in an office where little or no opportunity is afforded to exercise. At the same time, modern medicine has learned that exercise is an absolute necessity to a prolonged, healthy life. Thus, our society is peopled by individuals with little time or opportunity to exercise who, at the same time, are being told by their physicians that they should exercise at least one-half hour every other day.

To meet this phenomena, an increasing number of health spas, aerobic centers, and other exercise facilities are being opened. At the same time, more individuals are exercising at home or in the office using a variety of exercise equipment. Such exercise equipment includes, for example, rowing machines, stationary bicycles, cross country skiing machines, stair climbing machines, and treadmills. One disadvantage of these machines is that they are bulky and heavy and cannot be easily transported between home and office. Even when used in one place, they are generally unsightly and take up too much space.

If an individual has the desire to exercise particular muscle groups, such as the forearm for improved grip or the biceps and triceps, he or she faces a dilemma in that there is no one machine designed to exercise each of these muscle groups. Spring-loaded squeeze grips for exercising the forearm have been known for years. However, these spring-loaded grips cannot be used to exercise the upper arm.

SUMMARY OF INVENTION

Accordingly, it is an object of the present invention to provide an improved arm exercise machine.

It is another object of the invention to provide an arm exercise machine that is capable of exercising all of the major muscle groups within the arm, including the forearm, biceps, and triceps muscles.

It is yet another object of this invention to provide a portable, light-weight and compact arm exercise machine, which may be easily carried from home to office, and which may be used in any setting.

A further object of this invention is to provide an arm exercise machine that may be easily assembled from a plurality of parts that are economically manufactured.

In accomplishing these and other objects, the present invention utilizes a housing that mounts an internal pivot device. Extending from the housing in a first direction is a first brace that may be placed under the user's armpit. Extending in an opposite direction from the housing is a second brace that may be placed against the user's upper leg. Attached to the pivotal device within the housing is a pivot arm, which extends outwardly from the housing between the first and second braces, and which may be grasped and pivoted by the user to exercise his or her arm. During such exercise, the first and second braces counteract the force that the user generates while rotating the pivot rod to support the housing.

BRIEF DESCRIPTION OF THE DRAWINGS

A better understanding of the present invention and of further objects and advantages thereof, will become apparent to those skilled in the art after consideration of the following specification and drawings, wherein.

DESCRIPTION OF THE PREFERRED EMBODIMENTS

Figure 1:
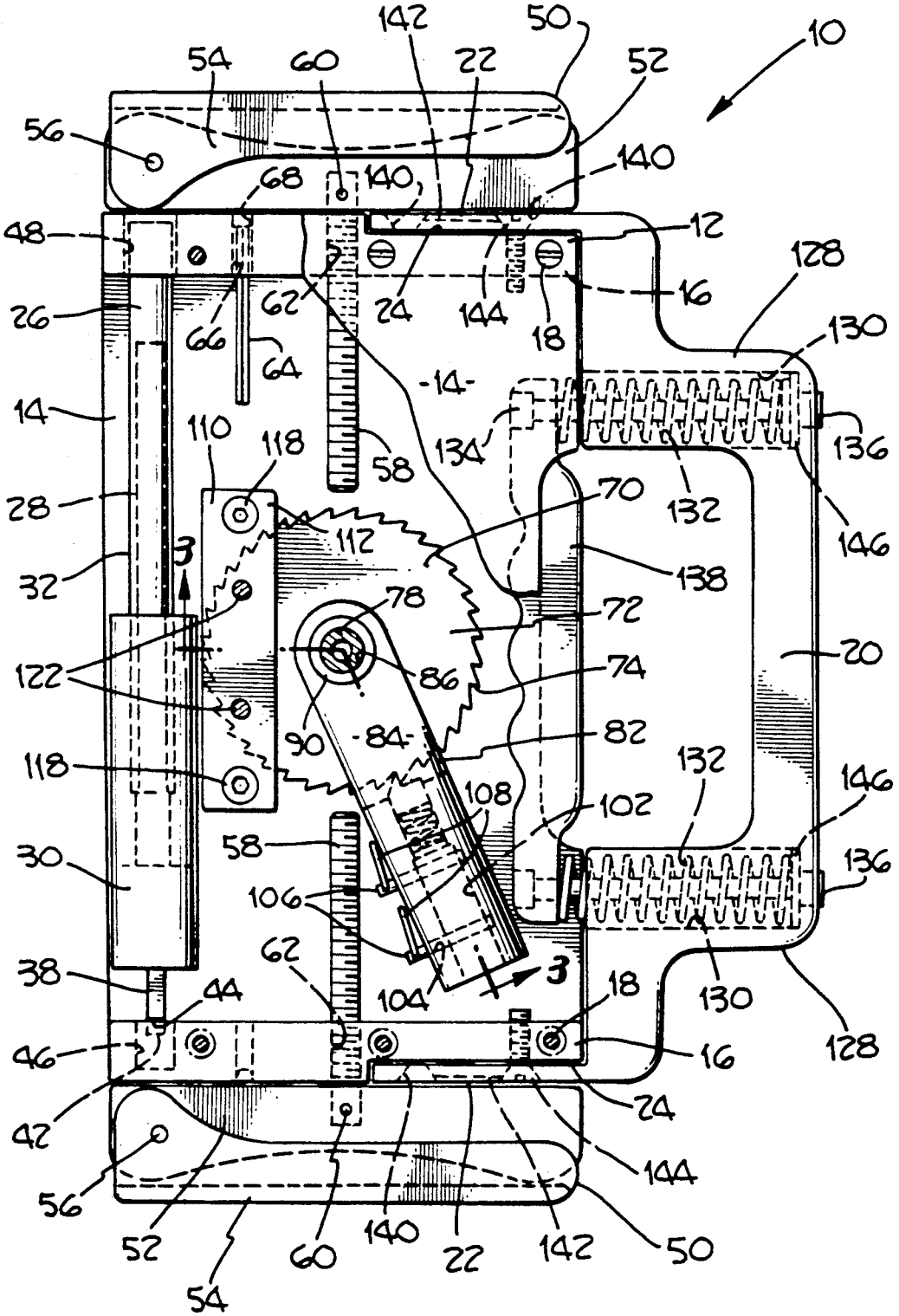
FIG. 1 is a side elevational view showing the arm exercise machine of the present invention with one of its side plates removed.
Figures 2, 3, 4, 5:
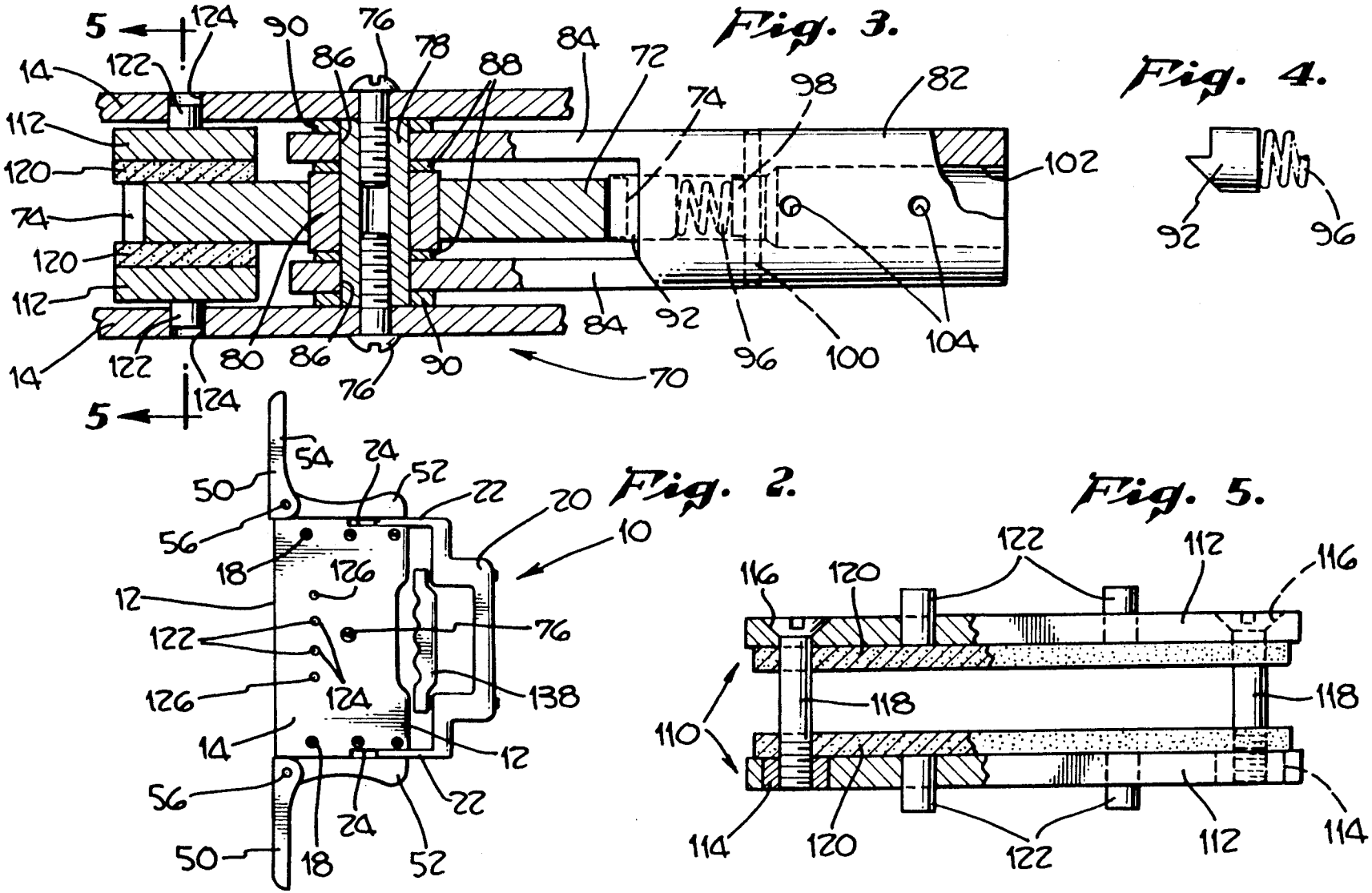
FIG. 2 is a side elevational view similar to FIG. 1 with the side plate replaced and its first and second braces and gripping mechanism partially extended.
FIG. 3 is a cross-sectional view taken along line 3—3 of FIG. 1.
FIG. 4 is a detailed view showing the rachet that mounts within the pivot arm.
FIG. 5 is a cross-sectional view taken along 5—5 of FIG. 3.

Referring now to the drawings, FIG. 1 shows an arm exercise machine 10 having a housing 12 formed from a pair of side plates 14, only one of which is shown in FIG. 1, the second being shown in FIG. 2. Side plates 14 are separated by end pieces 16, which may be attached to the side plates by suitable fastening means, such as screws 18 or bonding material. The side plates 14 and end pieces 16 may be made from high impact resistant plastic material, such as polystyrene or polycarbonate. These pieces may be molded or cut from sheets of the material selected.

Figure 6:
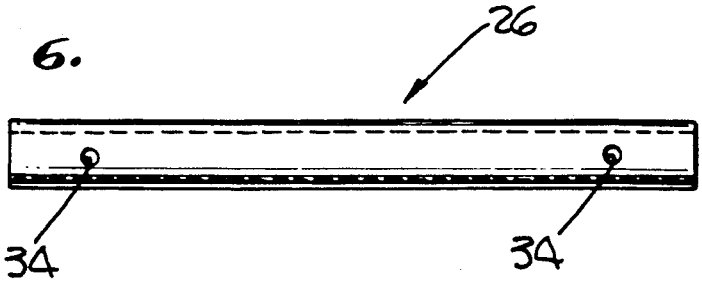
FIG. 6 is a side view of one segment of the pivot arm.
Figure 7:
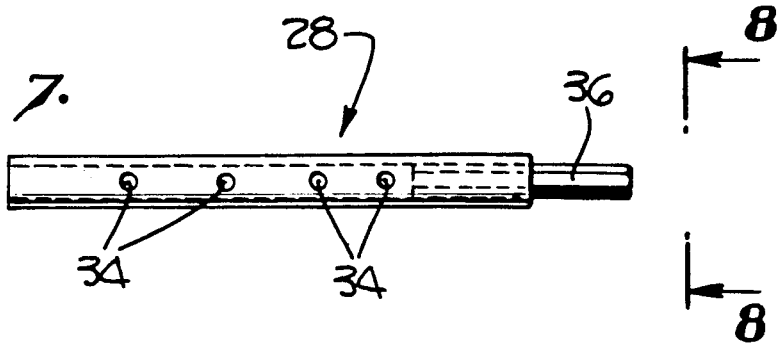
FIG. 7 is a side view of another segment of the pivot arm.

As seen in FIG. 1, the opening formed by end pieces 16 between side walls 14 is closed along its right-hand edge by a gripping member 20, which is generally U-shaped with extending legs 22 that fit into relief flats 24, cut into the sides of end pieces 16. The left-hand edge of housing 12 is opened to permit the storage of a plurality of rod segments 26, 28, and 30, which make up a pivot rod 32, best seen in FIG. 10. Rod segments 26, 28, and 30 are best seen in FIGS. 6, 7, and 9, respectively.

As seen in FIGS. 6–9, the first rod segment 26 that makes up the pivot rod 32 consists of a simple tube made from stainless steel, for example, having at least a pair of clearance holes 34 therein. The hollow tube 26 receives a second rod segment 28 which has four or more clearance holes 34 therein. Like rod 26, rod 28 may be constructed from a tubular piece of stainless steel whose size is chosen to permit the rod 28 to slide within the opening of tubular rod 26. The right-hand end of rod 28, FIG. 7, receives a hexagonal steel rod 36, best seen in FIG. 8, which may be secured within the end of rod segment 28 by welding, press fit, or the use of a pin passing through the radius of rods 28 and 30.

Figure 9:
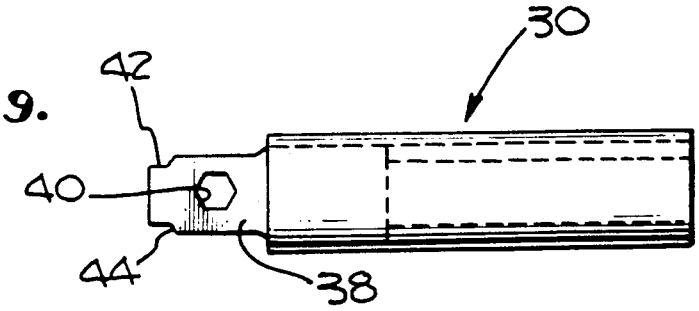
FIG. 9 is a side view of the handle which attaches to the pivot arm segment shown in FIG. 7.

The last portion of the pivot rod 32 is formed by a handle or rod section 30 shown in FIG. 9. Rod section 30 may be formed from a tubular piece of stainless steel having a handle mounting plate 38 inserted therein. The handle mounting 38 may be connected to handle rod section 30 by press fit, welding, retention pin, or other acceptable means. It will be seen that the handle mounting plate 38 includes a hexagonal aperture 40 whose flat surfaces are sized to slide fit over the flat surfaces of hexagonal rod 36 mounted in the end of rod segment 28. It should also be noted that the far, left-hand end of the handle mounting plate 38, FIG. 9, is relieved at 42 to provide a pair of shoulders 44.

Referring once again to FIG. 1, it will now be seen that the pivot rod 32 and its segments 26, 28, 30 may be stored within the housing 12 and retained therein when the exercise machine 10 is not being used. This may be done by placing rod segment 30 into the left-hand open end of housing 12 between side walls 14. The handle mounting plate 38 and its relief 42 is then inserted into an aperture 46 in the lower end piece 16. In this position, the shoulder 44 will engage the inner surface of end piece spacer 16. The rod segment 28 is then slid within the tubular opening of rod segment 26 and the two rods are passed through an aperture 48 in the upper end piece 16. The two rods 26 and 29 then extend down and through the tubular opening in the handle or rod segment 30. It will now be seen that the telescoped assembly of the three rod segments is retained within apertures 46 and 48. That is, the handle mounting plate 38 cannot pass through aperture 46 because of the presence of the shoulder 44. However, the handle segments 26 and 28 could fall through aperture 48.

Located on opposite ends of housing 12 are a pair of braces 50. The braces 50 form an important part of the arm exercise machine 10 in that they support the machine while in use. As seen in FIG. 2, each brace 50 consists of a base piece 52 and a side piece 54 attached by a pivot pin 56, such as a roll pin or a nut and bolt. Base member 52 is constructed with a generally solid, rectangular cross-section from a suitable high impact resistance plastic, such as polystyrene or polycarbonate. Side piece 54 has a U-shaped cross-section designed to fit about and cover base piece 52. The surface of base piece 52 and the edges of the legs of the U-shaped side piece 54 facing each other are rounded to form a smooth surface when opened about pivot pin 56, as seen in FIG. 2. This rounding provides a smooth surface for resting against the user's armpit or upper leg, as will be described below.

The braces 50 are each mounted to one of the end pieces 16 by a threaded rod 58, which passes through an aperture in each base piece 52 and is retained therein by a pin 60. As seen in FIG. each end piece 16 is provided with a threaded aperture 62, which receives the threaded rod 58. In the preferred embodiment, the threaded rod is constructed from a ⅜ inch piece of stainless steel. It will now be seen that the rotation of the upper brace 50, FIG. 1, will bring the brace into a face-to-face contact with end piece 16 for closing the aperture 48 that holds the pivot rod segments 26, 28 and 30, thus retaining the pivot rod 32 within housing 12. A hexagonal key or Allen wrench 64 may be stored within a suitable aperture 66 which passes through the upper end spacer 16. A groove 68 is also placed within the outer surface of end spacer 16 to accommodate the wrench 64 and to permit the brace 50 to retain the wrench 64 within aperture 66 and groove 68 during storage.

Referring now to FIGS. 1 and 3, a pivot mechanism 70 is shown. The pivot mechanism 70 receives the pivot rod 32 when the arm exercise machine 10 is in use. The pivot mechanism 70 consists of a ratchet wheel 72 having unidirectional ratchet teeth 74 mounted by screws 76 and a threaded bushing 78 between the side plates 14. The bushing 78 may be constructed from brass, teflon or other suitable material that provides a load-bearing surface. The height of the bushing 78 is designed to be the same as the thickness of end pieces 16. The screws 76 which pass through both side plates 14 retain the bushing 78 in its desired position. The ratchet wheel 72 may itself be provided with a bushing 80 which slidably fits over the bushing 78 and is press fit, for example, into the ratchet plate 72. Alternately, the ratchet plate 72 may ride directly upon the bushing 78. A U-shaped armature 82 having a pair of legs 84 fits between the side plates 14 and ratchet wheel 72 with apertures 86 within each leg for slidably fitting about the bushing 78. It will be seen in FIG. 3, that the U-shaped armature 82 is designed with the opening that forms the U deep enough to adequately clear the ratchet wheel 72. The legs 84 of armature 82 may be separated from the ratchet wheel bushing 80 by washers 88 and from the side plates 14 by washers 90. These washers may be constructed from steel or low friction material, such as teflon.

The ratchet teeth 74 of rachet wheel 72 are engaged by a ratchet 92, FIG. 4, which is slidably received in an aperture 94 passing through the longitudinal axis of the U-shaped armature 82. The ratchet 92 is spring-loaded toward ratchet teeth 74 by a compression spring 96 that rests upon a washer 98 retained within aperture 94 by a retention pin 100. As seen in FIG. 3, the aperture 94 in armature 82 is expanded to form a, pivot rod receiving aperture 102. Passing through the sides of armature 82 and the center of aperture 102 are clearance holes 104 which received a pair of detent pins 106 for storage, see FIG. 1. The detent pins 106 include pull rings 108 and are used to assemble the pivot rod 32, as will be explained below.

The force required to rotate the U-shaped armature 82 in a direction where the ratchet 92 engages the ratchet teeth 72 without slipping is controlled by a brake assembly 110 best seen in FIG. 5. The brake assembly 110 consists of a pair of brake plates 112, that may be constructed form ¼ inch thick stainless steel. The lower break plate 112 is provided with a pair of threaded bushings 114, while the upper brake plate 112 is provided with a pair of aligned counter-sunk holes 116 that receive flat head screws 118 having hexagonal apertures therein. It will be seen in FIGS. 3 and 5 that the facing surfaces of brake plates 112 are provided with brake shoes 120, that may be attached thereto by bonding. The brake shoes may be formed from 3/16 inch thick brake band material. It will also be seen that the brake plates and brake shoes 112 and 120 are free to float on either side of the ratchet wheel 72. As seen in FIG. 1, the screws 118 that hold the brake plates 112 together are arranged outside the radius of the ratchet wheel 72. Each brake plate 112 is provided with a pair of alignment pins 122 which are retained therein by a press fit. The alignment pins 122 float within apertures 124 located in side plates 14, FIG. 2, to permit the brake shoes 120 to remain aligned with ratchet wheel 72. The side plate 14, shown in FIG. 2, is also provided with clearance apertures 126 which permit the Allen wrench 64 to be inserted into the hexagonal apertures in screws 118. As the screws 118 are tightened within the threaded bushings 114, they draw the two brake plates 112 and mounted brake shoes 120 ever tighter against opposite surfaces of ratchet wheel 72.

The foregoing completes the description of the arm exercise machine, but for describing the spring-loaded grip device for exercising the user's forearm muscles. As seen in FIG. 1, the U-shaped gripping member 20 actually includes a double U-shape. That is, the first U is formed with a first pair of legs 128, which extend in opposite directions at the ends thereof to meet and support the second pair of legs 22. A pair of apertures 130 is bored within the legs 128 of the gripping member 20 to receive a pair of compression springs 132 that are retained therein by a pair of nuts and bolts, 134 and 136. The pair of bolts 136 pass through the outer surface of gripping member 20, through apertures 130, and then through a second gripping handle 138, where the nuts 134 retain the handle 138 against the compression forces of springs 132. It will be seen that the apertures 132 are channels along the inner surfaces of the U-shaped legs 128, which permit the second gripping handle 138 to be squeezed toward the outer base of the U-shaped gripping member 20 to exercise the user's forearm muscles.

The outer surfaces of the U-shaped legs 22 of the gripping member 20 are each provided with a pair of counter-sunk apertures 140 joined by a groove 142 that is also V-shaped, but not to the same depth as the counter-sunk apertures 140. A flathead screw 144 passes through each inner most counter-sunk aperture 140 and is threadably engaged within end pieces 16, as best seen in FIG. 1. The screws 144 permit the outward movement of gripping member 20 when loosened, yet prevent its separation from housing 12.

Having thus described the arm exercise machine 10, the operation thereof will be described with reference to FIGS. 1, 2, and 10–13. The assembled arm exercise machine 10 is shown in FIG. 1 with the side cover 14 removed for clarity. When a user wished to use the exercise machine, he or she first rotates the braces 50 to expose the pivot rod 32 and its segments, the key 64, and the hex head screws 144. The key 64 is removed and screws 144 loosened. The gripping member 20 is then pulled out to its extended position, as shown in FIG. 2, where the gripping member 20 and its second gripping handle 138 may be used to exercise the forearm muscles of the user's right or left arm.

Figure 10:
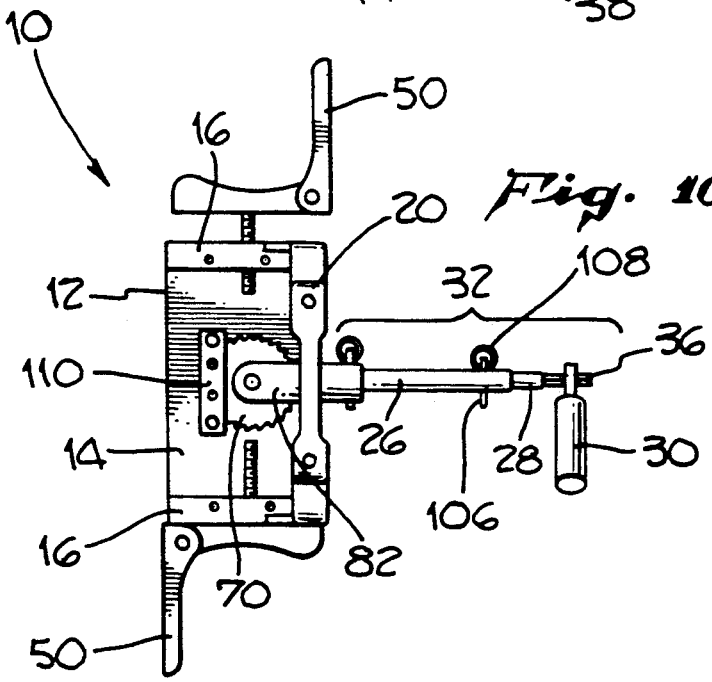
FIG. 10 is a view similar to FIGS. 1 and 2 with the side plate removed, the first and second braces partially extended, the gripping member extended and pivoted toward the reader, and the pivot rod assembled.
Figure 8:
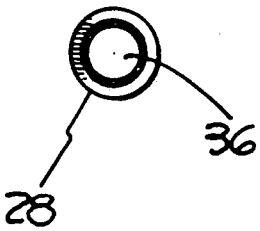
FIG. 8 is an end view of FIG. 7.

After this exercise, the gripping member 20 may be rotated to either one side or the other of housing 12 where the screws 144 are tightened. The U-shaped armature 82 may now be rotated to expose the aperture 102 in the end furthest from its pivot assembly 70. Pivot rod 32, including its three sections 26, 28, and 30, is now removed from the housing 12. First, the two telescoped rod segments 26 and 28 are removed through aperture 48. Next, the handle segment 30 is removed from between the side plates 14. The detent pins 106 are removed, by pulling rings 108, from their storage apertures 104; and the first rod segment 26 is inserted into aperture 102 in armature 82. The rod segment 26 is then retained within aperture 102 by passing a detent pin 106 through the aperture 104 in armature 82, and through the aperture 34 in rod segment 26. The second rod segment 28 is then placed into the inner diameter of tubular rod segment 26 and retained therein by passing the second detent pin 106 through the desired clearances holes 34 in rod segments 26 and 28. Handle 30 is then placed upon rod segment 28 by aligning the hexagonal aperture 40 with hexagonal rod 36. Next, the braces 50 are opened so that the side pieces 54 are at right angles to the brace pieces 52. Each brace is then rotated until its mounting, threaded rod 58 has extended a desired distance from end piece 16. The assembly described thus far is best seen in FIG. 10.

Figure 11:
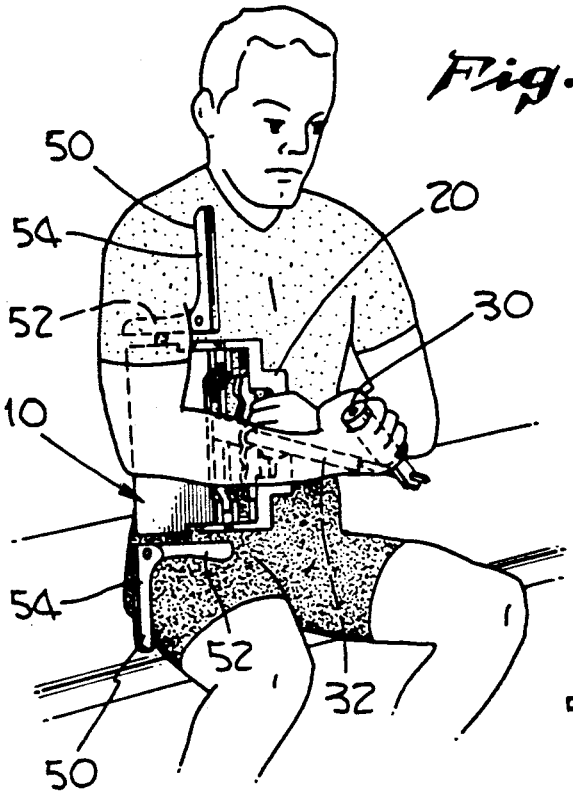
FIG. 11 shows the arm exercise machine as it would be used to perform a curl to exercise the bicep muscles.

After the braces 50 have been extended to the desired position, the arm exercise machine 10 is positioned against the body to begin exercising the bicep or tricep muscles. If it is desired to perform a curl to exercise the bicep muscles, as shown in FIG. 11, the upper brace 50 is arranged so that the base 52 fits under the armpit while the side piece 54 rests against the front of the shoulder. Similarly, the lower brace 50 has been extended in an opposite direction and is placed against the upper portion of the thigh so that the base 52 rests against the top of the thigh and the side piece 54 rests against the outer portion of the user's leg. The side pieces 54 are now in a generally vertical position. The user may place the handle 30 on the hexagonal rod 36 in a slightly upward direction to facilitate the upward motion of a curl. When the arm is exercised in the manner shown in FIG. 11, the ratchet 92 will engage ratchet teeth 74 to drive the ratchet wheel 70 in a counter-clockwise direction. As the arm is lowered, ratchet member 92 skips over the ratchet teeth 74 as the spring 96 permits the ratchet to disengage from the teeth. With each upward motion of the arm, the upper brace 50 prevents counter-clockwise motion of housing 12 by pushing against the inner shoulder; while a similar counter-clockwise motion is prevented by the lower brace 50 on the outer leg.

Figure 12:
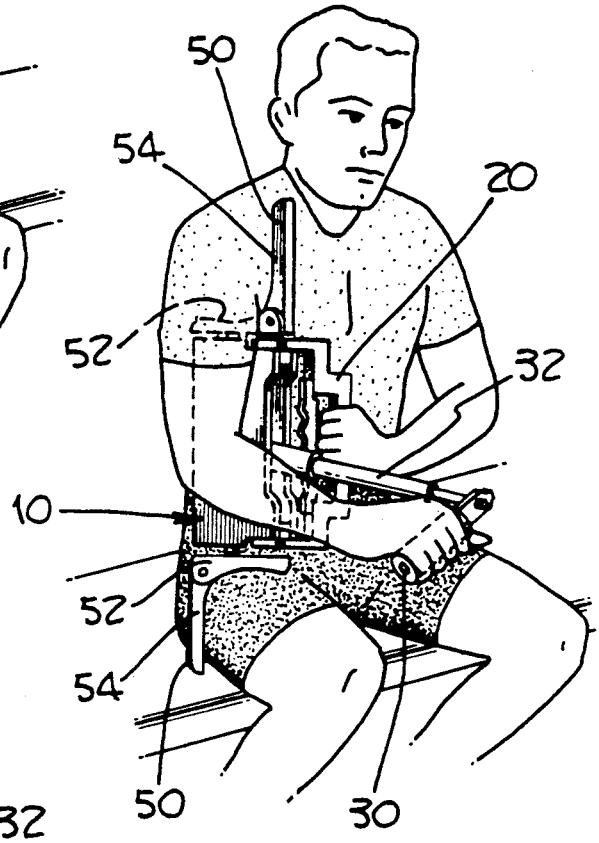
FIG. 12 shows the arm exercise machine as it would be used to perform a back curl to exercise the bicep muscles.
Figure 13:
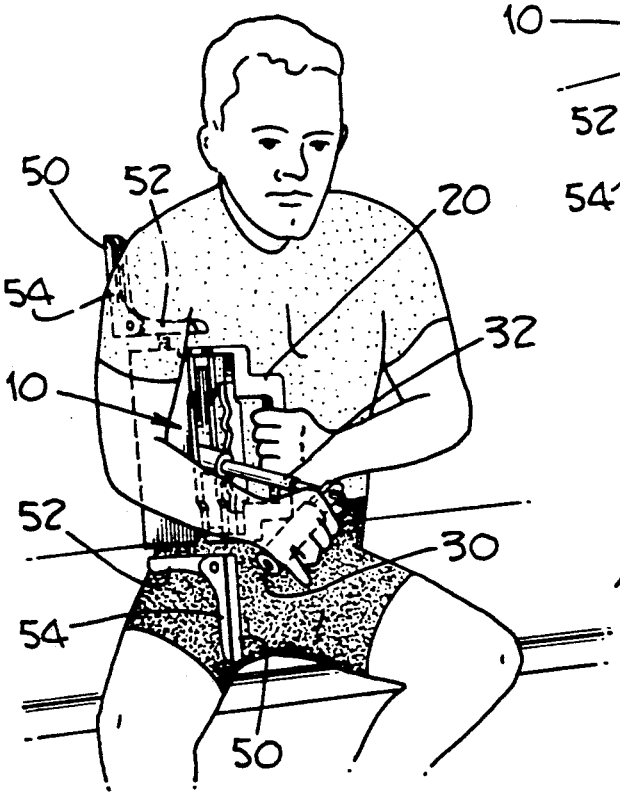
FIG. 13 shows the arm exercise machine as it would be used to exercise the tricep muscles.

A reverse curl, may be accomplished by simply removing handle 30 from the hexagonal end 36 of rod segment 28 and rotating the handle down slightly so that its angle is in a downward direction, as seen in FIG. 12. In this configuration, the exercise machine 10 operates in the same manner as it did with FIG. 11.

When it is desired to exercise the tricep muscles, the machine 10 is reversed. First, the pivot rod 32 is removed by removing the detent pin 106, which passes through the armature 82. Screws 44 may require loosening to move the grip member 20 to the opposite surface of the housing 12. The pivot rod 32 is then replaced and the braces rotated 180°. The upper brace 50 is then placed under the armpit with the side piece 54 pressing against the back of the shoulder, while the lower brace 50 is again placed on the upper leg with the side piece 54 pressing against the inner surface of the user's leg. In this configuration, shown in FIG. 13, the ratchet wheel resists a downward or clockwise motion and ratchets in an upward or counter-clockwise motion. This permits the user to exercise the tricep.

Once the user has completed his or her exercise, the arm exercise machine 10 may be disassembled into a compact and lightweight unit for storage by reversing the assembly steps described above. The exercise machine 10 may then be easily carried from home to office and back again by the gripping member 20 that forms a convenient handle. It will now be understood that the exercise machine described above is easy to manufacture and to use for exercising the forearm, bicep and tricep muscles.

The arm exercise machine 10 is provided with adjustment of most of its components. Recall that the braces 50 may be adjusted up or down due to their mounting on threaded rods 58. Similarly, the exact location of the brace 50 with regard to the plane formed by housing 12 may also be adjusted. The length of the pivot rod 32 may be adjusted by placing the detent pin 106 in different clearance holes 34 found within the second rod segment 28. The angle of the handle 30 as it joins the hexagonal end 36 of rod 28 may be adjusted depending upon the way the hexagonal aperture 40 of handle 30 is aligned with the hexagonal rod end 36 of rod segment 28. The angle of the gripping member 20 which is held by the user's arm and hand not being exercised may be adjusted by rotation of the U-shaped legs 22 about the housing 12 and the tightening of screws 144. Next, the torque or resistance to motion of the pivot rod 32 may be adjusted by inserting the key 64 through apertures 126 in side plate 14, FIG. 2, and tightening or loosening the hexagonal screws 118 exposed by the apertures. Lastly, the spring compression forces on the squeezable handle formed by gripping members 20 and 132 may be increased by disassembling the nuts and bolts, 134 and 136, and placing additional spacer washers 146 within the apertures 130. It will be understood that other adjustments, variations, and modifications are possible within the teaching of the present invention. Accordingly, the present invention should be limited only by the appended claims.

I claim:

1. An arm exercise machine, comprising:

a housing having a pivot therein;

a first brace extending from said housing in a first direction;

a second brace extending from said housing in a second direction generally opposite to said first direction with said pivot in said housing generally therebetween;

said first and second braces having hook-like portions for engagement under a user's armpit and against the user's upper leg; and a pivot rod rotatably attached to said housing by said pivot therein which is grasped and pivoted by the user to exercise the user's arm while said first and second braces support said housing.

2. The arm exercise machine of claim 1, additionally comprising;

said hook-like portions of each first and second braces extended from said housing by a rod which rotates to adjust the position of each said hook-like portion with respect to said housing.

3. The arm exercise machine of claim 2, wherein:

said rods are threaded and threadably attached to said housing to adjust each of said hook-like portion of said brace away from and toward said housing and into a plane different from said housing.

4. The arm exercise machine of claim 1, additionally comprising:

said pivot includes a wheel rotatably driven by said pivot rod; and a brake for engaging said wheel to resist rotation of said pivot rod.

5. The arm exercise machine of claim 4, additionally comprising:

said brake including a pair of plates on each side of said wheel; and fasteners joining said pair of plates to adjustably apply pressure to said wheel to adjust said resistance to said rotation of said pivot arm.

6. The arm exercise machine of claim 4, additionally comprising:

said pivot rod including a ratchet for rotatably driving said wheel in but one direction.

7. The arm exercise machine of claim 1, additionally comprising:

a gripping member attached to said housing which is gripped by said user's arm to further support said housing while the user's other arm is grasping said pivot rod.

8. The arm exercise machine of claim 7, additionally comprising:

said gripping member pivotably attached to said housing to permit said gripping member to be pivoted from one side of said housing to the other side thereof.

9. The arm exercise machine of claim 8, additionally comprising:

said gripping member having a general U-shape with the legs of said U-shape attached to said housing:

a second gripping member spaced from and attached to the first mentioned, U-shaped gripping member between the legs thereof; and spring means for urging said second gripping member away from said first mentioned gripping member to form an exercise device for the user's forearm.

10. The arm exercise machine of claim 1, additionally comprising:

said pivot rod including a handle mounted within a plane that is generally normal to said pivot rod.

11. The arm exercise machine of claim 10, additionally comprising:

said pivot rod having an axis and an end having a plurality of flats thereon parallel to said axis; and said handle having an aperture therein with a plurality of flats within said aperture corresponding in number to the plurality of flats on said pivot rod end, wherein said handle may be adjusted at different angles upon said rod and within said plane generally normal to said rod.

12. The arm exercise machine of claim 1, wherein:

said pivot rod includes a plurality of rods for adjusting the length of said pivot rod.

13. The arm exercise machine of claim 12, wherein said plurality of rods includes:

a first rod rotatably attached to said housing;

a second rod attached to said first rod; and pins for securing said first rod to said housing and said second rod to said first rod.

14. The arm exercise machine of claim 1, wherein:

said first and second brace and said pivot rod may be stored against and within said housing when not in use.

15. An arm exercise machine, comprising:

a housing having a pivot therein;

said housing adapted to be braced against a user's body;

a pivot rod rotatably attached to said housing by said pivot therein;

said pivot including a ratchet wheel and a ratchet;

a brake assembly engaging said ratchet wheel to adjust the torque applied by said ratchet wheel to said pivot rod a first hook-like brace extending from said housing in a first direction adapted to engage the armpit of said user; and a second hook-like brace extending from said housing in a second, generally opposite direction from said first brace adapted to engage the upper leg of said user.

* * * * *